United States Patent [19]

Zbriger et al.

[11] 4,276,717

[45] Jul. 7, 1981

[54] PERIODICALLY SWERVING TOY VEHICLE

[75] Inventors: Michael J. Zbriger, Bridgeport, Conn.; Anthony Passamenti, Wantagh, N.Y.

[73] Assignee: Aurora Products Canada, Ltd., Rexdale, Canada

[21] Appl. No.: 4,952

[22] Filed: Jan. 19, 1979

[51] Int. Cl.[3] ..... A63H 17/36; A63H 17/00; A63F 9/14

[52] U.S. Cl. ..... 46/262; 46/252; 273/86 B

[58] Field of Search ..... 46/252, 262, 251, 253, 46/254–261; 273/86 B

[56] References Cited

U.S. PATENT DOCUMENTS

| | | | |
|---|---|---|---|
| 3,717,952 | 2/1973 | Strongin | 46/252 |
| 4,079,938 | 3/1978 | Beny et al. | 46/262 |

*Primary Examiner*—Gene Mancene
*Assistant Examiner*—Michael J. Foycik
*Attorney, Agent, or Firm*—Blum, Kaplan, Friedman

[57] ABSTRACT

A toy vehicle for multiple lane track racing includes rear wheels releasably driven for traction and pivotable front wheels for steering. The pivotable front wheels pivot in unison periodically at a repetition rate directly related to the rotational speed of the motor thereby causing the car to swerve alternately between two lanes on opposed sides of the track. The wheel pivoting mechanism may include a cam and snail gear for speed reduction. Pick-up shoes attached beneath the car chassis contact power conductors along the track lanes to energize the motor. An input circuit on the vehicle provides forward vehicle motion regardless of the input voltage polarity. When the vehicle is intermediate the vehicle lanes, the motor is de-energized and a clutch may disengage the rear wheels.

11 Claims, 14 Drawing Figures

PERIODICALLY SWERVING TOY VEHICLE

BACKGROUND OF THE INVENTION

This invention relates generally to a toy vehicle for children and more particularly to a toy vehicle having a self-contained electric motor and used for racing on a model track. Miniature toy vehicles of this general type running on a closed track have been successfully manufactured and marketed over a period of years. These items are extremely popular with children and adults alike. Realism is an important part of the appeal of these toys. Efforts are continuously made to produce miniature vehicles and miniature tracks which provide greater challenges to the skill of the operators. Newer models of racing vehicles include the capability for steering which allows obstacles to be circumvented, cars to be passed and lanes to be changed. Slow moving drone vehicles have also been added to the tracks which force the competitors to pass them or otherwise be retarded in their progress. However, the predictable path of travel of these drone vehicles greatly reduces the challenge which they present to the car operators.

What is needed is a toy vehicle for miniature car racing which moves about the track without operator control, varies its speed in proportion to the speed of the racing cars, and swerves from track to track in a seemingly random pattern. Further it is desirable that the vehicle operates in a powered condition regardless of the lane upon which it is travelling.

SUMMARY OF THE INVENTION

Generally speaking, in accordance with the invention, an electrically operated toy vehicle which swerves periodically during its travel along a miniature track, is provided. The toy vehicle for multiple lane track racing includes rear wheels releasably driven for traction and pivotable front wheels for steering. The pivotable front wheels pivot in unison periodically at a repetition rate directly related to the rotational speed of the motor thereby causing the car to swerve alternately from side lane to side lane on the track. The wheel pivoting mechanism intermediate the front wheels and motor includes speed reduction means. Pick-up shoes attached beneath the car chassis contact DC power conductors along the track lanes to energize the motor. Three pick-up shoes may be provided to allow the vehicle to operate on eitherside lane of the track and the input circuit provides forward vehicle motion regardless of the input voltage polarity. When the vehicle is intermediate the vehicle lanes, the motor is de-energized and a clutch may disengage the rear wheels.

Accordingly, it is an object of this invention to provide a toy vehicle for miniature car racing which includes pivotable wheels to produce a swerving travel path.

Another object of this invention is to provide a periodically swerving toy vehicle which swerves at a repetition rate directly related to the rotational rate of the vehicle's electrical motor.

A further object of this invention is to provide a periodically swerving toy vehicle which moves in the forward direction regardless of the applied voltage polarity.

Yet another object of this invention is to provide a periodically swerving toy vehicle which crosses racing track lanes and is powered in all track lanes.

Still another object of this invention is to provide a periodically swerving toy vehicle which swerves at a repetition rate in proportion to the speed of the vehicle.

Another object of this invention is to provide a periodically swerving toy vehicle which operates on a multi-lane track without the need for an operator.

A still further object of this invention is to provide a periodically swerving toy vehicle which provides freewheeling of the drive wheels when the vehicle is between track lanes.

Still other objects and advantages of the invention will in part be obvious and will in part be apparent from the specification.

The invention accordingly comprises the features of construction, combination of elements and arrangements of parts which will be exemplified in the construction hereinafter set forth, and the scope of the invention will be indicated in the claims.

BRIEF DESCRIPTION OF THE DRAWINGS

For a fuller understanding of the invention reference is had to the following description taken in connection with the accompanying drawing, in which.

FIGS. **12*a* and 12*b* are electrical schematics of racecars for operation on the tracks of FIG. 11.

DESCRIPTION OF THE PREFERRED EMBODIMENTS

Figure 1:
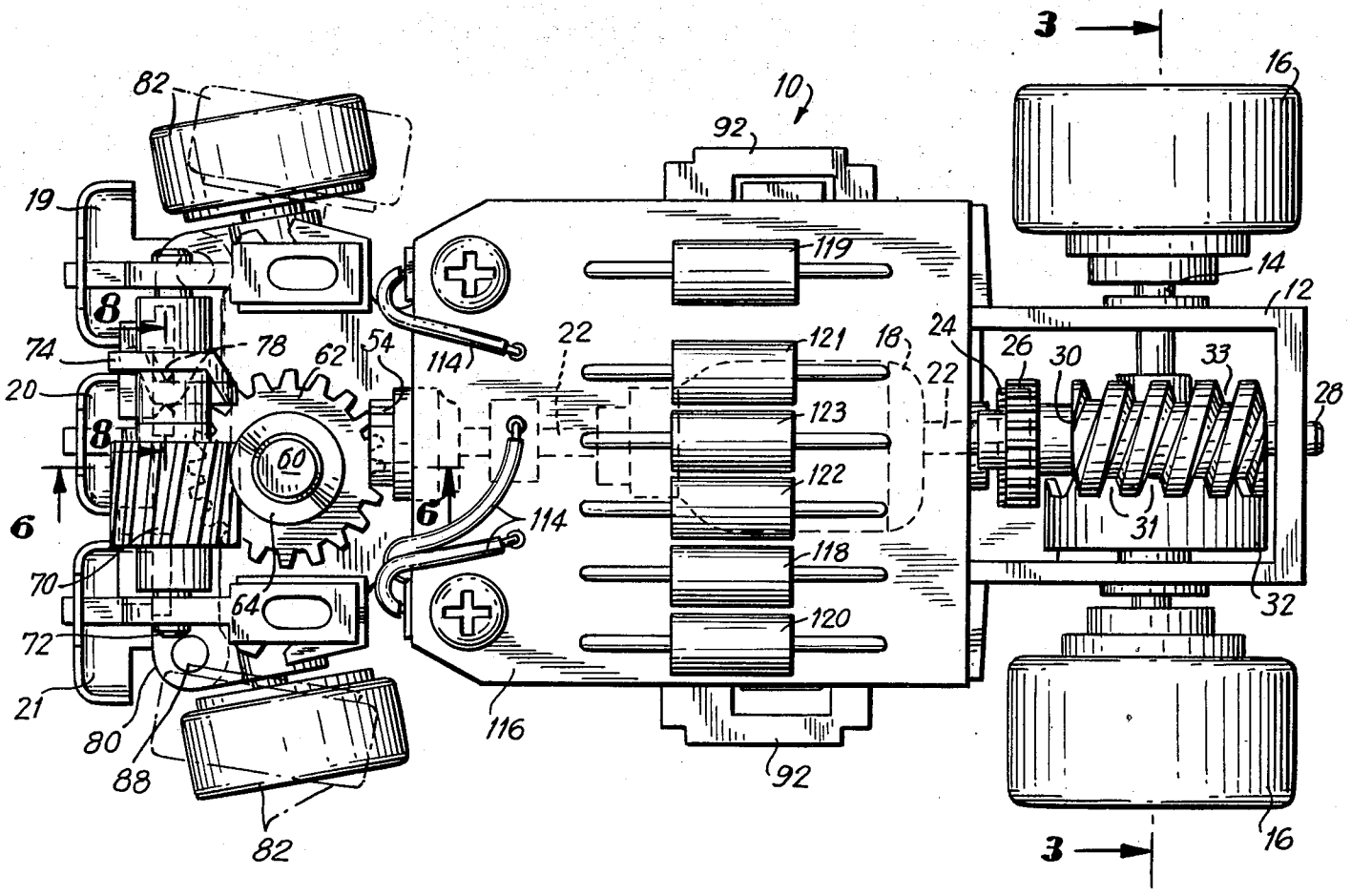
FIG. 1 is a top view of the toy vehicle of this invention with the appearance shell removed.
Figure 2:
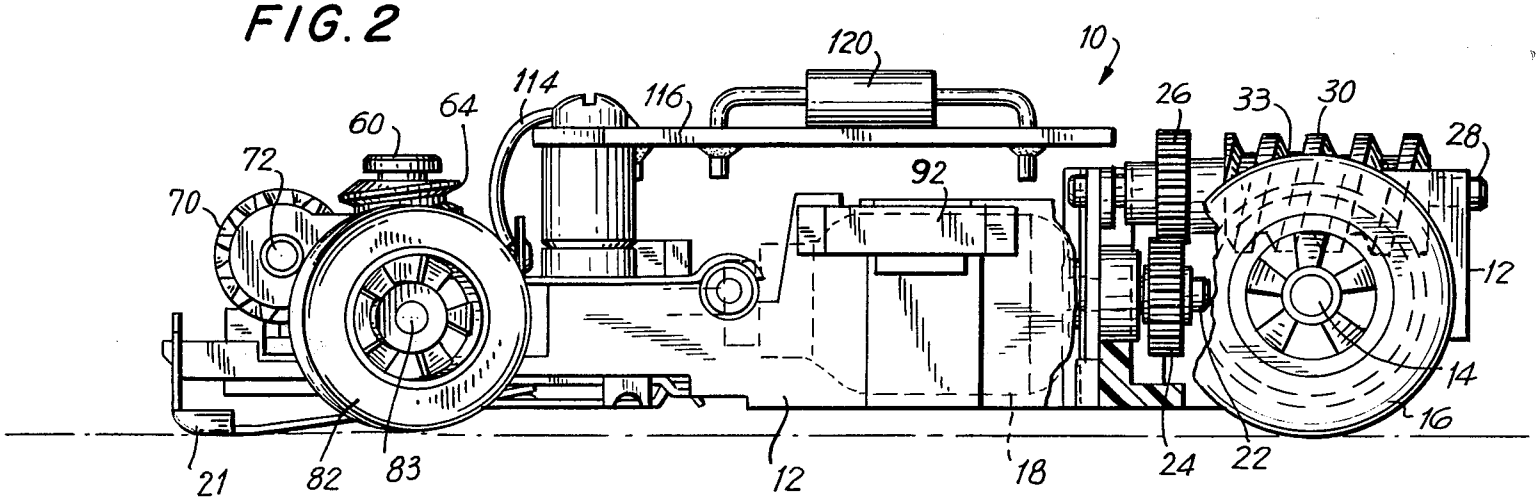
FIG. 2 is a side elevational view of the vehicle of FIG. 1.

With reference to the Figures, the vehicle 10 of this invention includes the vehicle chassis 12 supporting the rear axle 14 rotatably mounted on said chassis 12, a pair of rear wheels 16 fixedly attached to said rear axle 14 and a motor 18 centrally mounted on said chassis 12. The motor 18 is electrically powered. Energy to drive the motor is drawn from charged conductors located on the surface of the track upon which the vehicle of this invention runs. As discussed hereinafter, electrical contact with the charged conductors is made by the pick-up shoes 19, 20, 21 located on the bottom of the vehicle chassis 12. The motor 18 is mounted in the chassis 12 with the motor shaft 22 extending longitudinally, front to rear, in the vehicle 10. The pinion 24, attached rigidly to the rear extension of the shaft 22 from the motor 18, engages the spur gear 26. The spur gear 26 is fixedly attached to the worm shaft 28 which has its ends journaled for rotation in the chassis 12. The worm gear 30 is mounted to the worm shaft 28 and turns therewith, the rotational axis of the worm shaft 28 being parallel to the motor shaft 22. The teeth 31 of the crown gear 32 engage the threads or spiral groove 33 of the worm gear 30 such that when the motor is energized, rotation of the motor shaft 22 causes the crown gear 32 to rotate by means of the intermediate pinion 24, spur gear 26, and worm gear 30.

Figure 4:
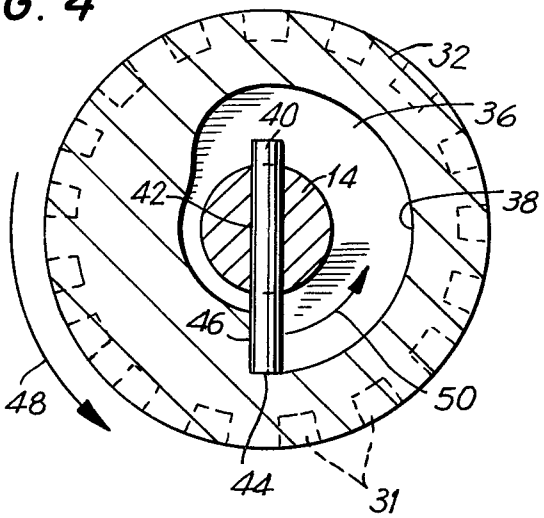
FIG. 4 is a view to an enlarged scale taken along the line 4—4 of FIG. 3.
Figure 3:
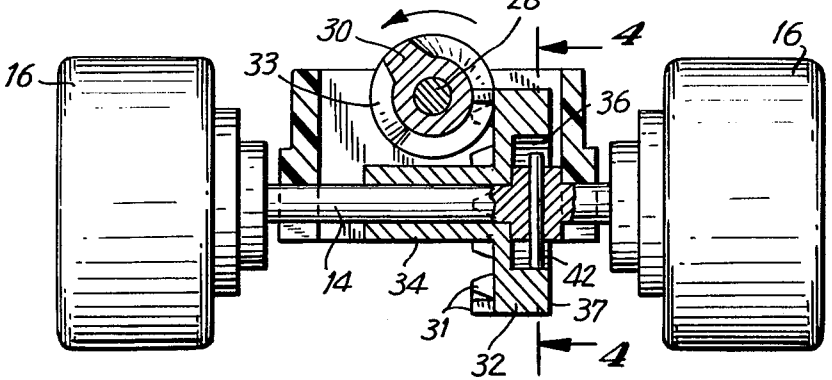
FIG. 3 is a view taken along the line 3—3 of FIG. 1.

As may best be seen in FIGS. 3 and 4, the crown gear 32 is releasably engaged with the rear axle 14. An extended collar 34 on the crown gear 32 rotatably slides on the rear axle 14 to insure true alignment of the crown gear 32. The recess 36 in the back surface 37 of the crown gear hub is peripherally contoured to form a cam profile 38. The pin 40 fits slidingly in the hole 42 passing transversely through the rear axle 14 and the lower end 44 of the pin 40 rides on the cam profile 38. A planar surface 46 in the cam profile 38 extends substantially radially in relation to the axis of rotation of the rear axle 14. Accordingly, when the crown gear 32, driven by the motor 18, rotates in the direction indicated by the arrow 48, the planar surface 46 pushes against the sliding pin 40 and causes it to rotate with the crown gear 32. The pin 40 drives the rear axle 14 and causes the rear wheels 16 to rotate providing forward motion to the vehicle 10 of this invention when the motor 18 is energized. However, it should be noted that when the motor 18 is de-energized and the rear wheels 16 are still rotating, that is, the vehicle is coasting, the pin 40, rotating with the rear axle 14, slides relative to the cam profile 38 in the direction indicated by the arrow 50 in FIG. 4. The lower end 44 of the pin 40 then travels around the entire periphery of the cam profile 38 without any engagement which would cause the crown gear 32 to rotate. Thus, when the motor 18 is not energized, there is free-wheeling of the rear wheels 16. When the motor 18 is re-energized, the pin 40 again is engaged by the planar surface 46 on the cam profile 38 and the wheels are again driven in the forward direction. Thus it is seen that the motor 18 can only provide forward motion of the vehicle 10 of this invention.

Figure 6:
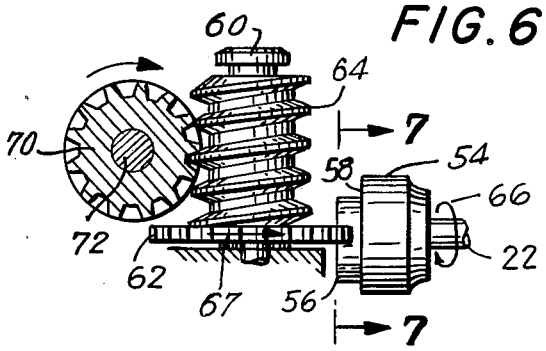
FIG. 6 is a view taken along the line 6—6 of FIG. 1.
Figure 7:
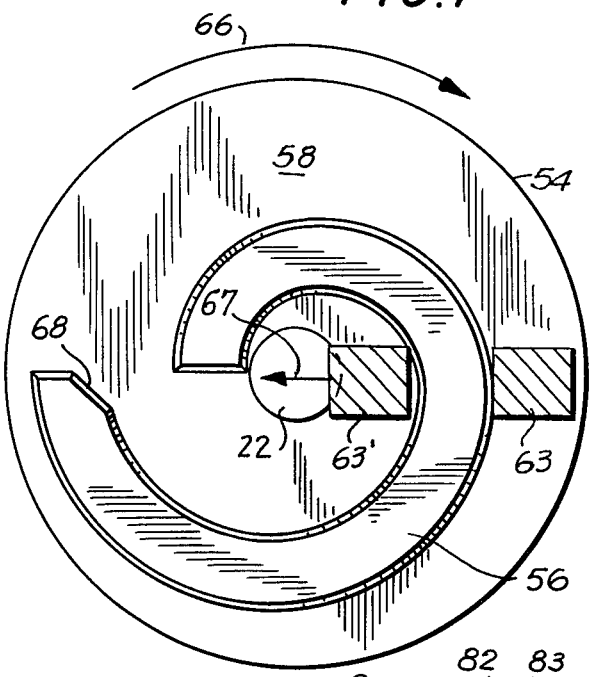
FIG. 7 is a view to an enlarged scale taken along the line 7—7 of FIG. 1.
Figure 8:
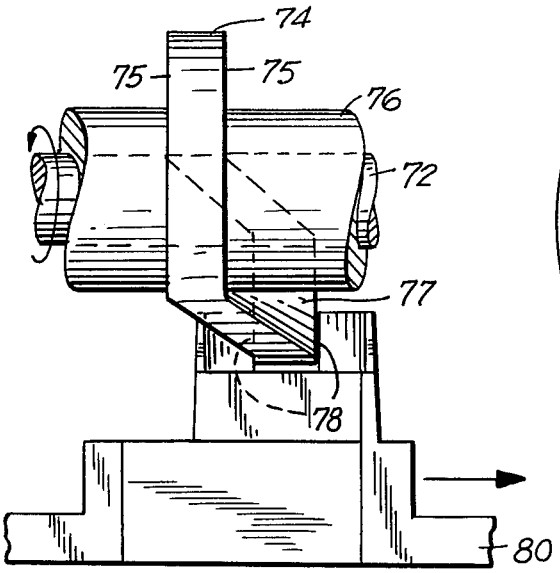
FIGS. 8 and 9 are views in elevation to an enlarged scale taken along the line 8—8 of FIG. 1.
Figure 9:
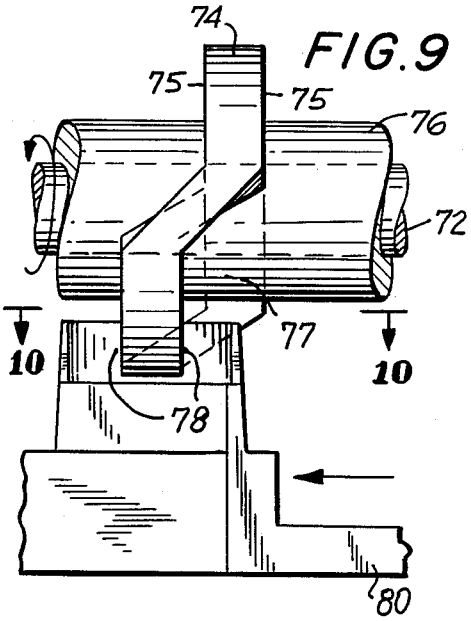
Figure 10:
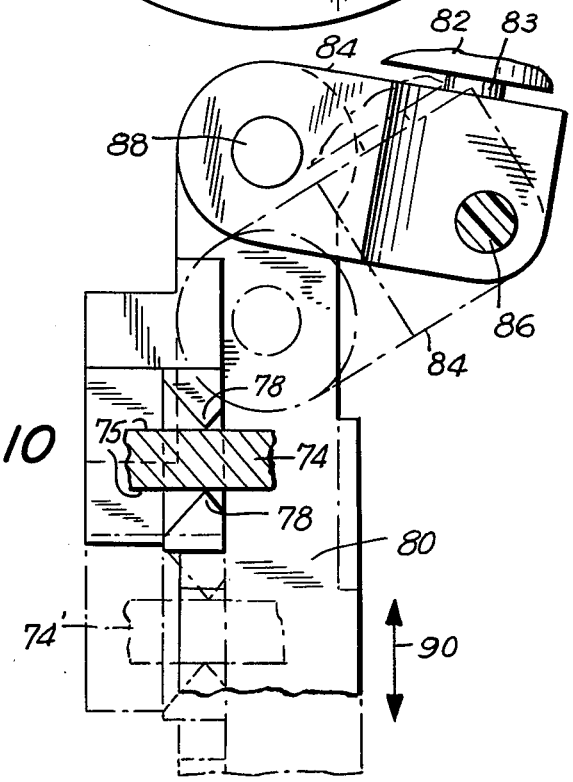
FIG. 10 is a view taken along the line 10—10 of FIG. 9.

Power steering for the vehicle 10 of this invention is provided by pivotable front wheels 82 which are operatively connected to the motor 18 as described hereinafter. The shaft 22 of the motor 18 is double-ended and extends forward to connect with the snail gear 54. As best seen in FIGS. 1, 6 and 7, the snail gear 54 has one elongated tooth 56 which is elevated above the planar surface 58 on the snail gear 54. The elongated tooth 56 forms essentially a single coil of an open spiral on the planar face 58 on the gear 54. The spiral tooth 56 rotates in a vertical plane. The cluster gear 60 comprises the spur gear 62 integrally joined to the worm gear 64 and oriented for rotation about a vertical axis. The elongated spiral tooth 56 of the snail gear 54 is engaged between two adjacent teeth 63, 63' of the spur gear 62. When the motor 18 and its shaft 22 rotate in the direction indicated by the arrow 66 (FIG. 7), the teeth 63 on the spur gear 62 are drawn to the center of the spiral tooth 56 and move in the direction indicated by the arrow 68. The relative motion of the spiral tooth 56 and the teeth 63 on the spur gear 62 is substantially transverse at their points of contact. It can be seen in FIG. 7, that the tapered leading edge 68 of the elongated spiral tooth 56 will loop around the right-hand tooth 63 (FIG. 7) after an additional rotation of approximately 180° of the gear 54. This additional 180° of rotation corresponds approximately to the point where the left-most tooth 63' of FIG. 7 is released from engagement with the spiral tooth 56. Thus, it can be seen that there is a continuous process of engagement and disengagement of teeth 63, and the spur gear 62 is slowly rotated by the angular pitch distance of one tooth 63, each time the spiral tooth 56 engages and rotates to the point of disengagement with a tooth 63 of the spur gear 62.

Figure 5:
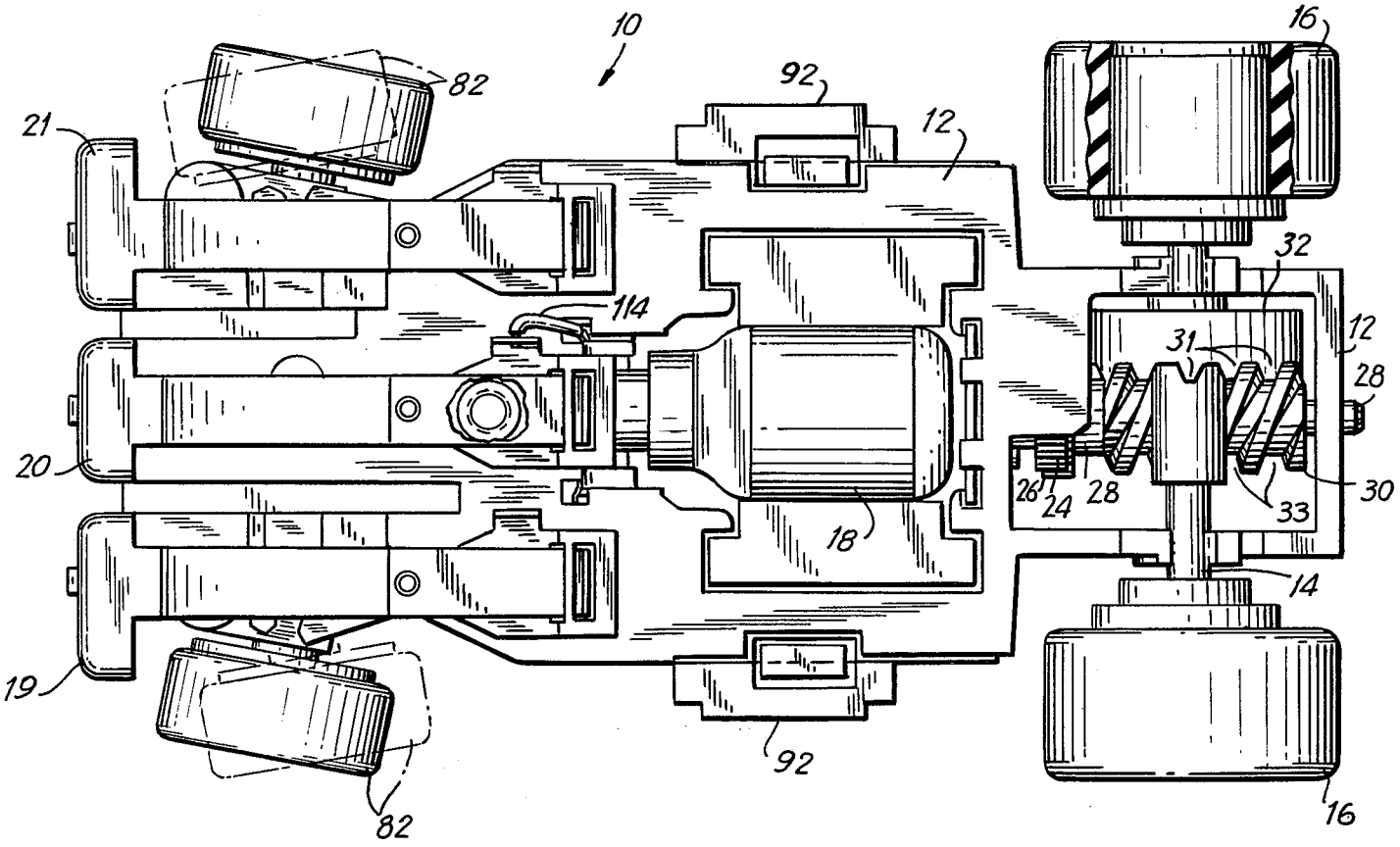
FIG. 5 is a bottom view of the vehicle of FIG. 1.

The integral worm gear 64 rotates with the spur gear 62 and teeth of the worm gear 64 engage teeth of the steering gear 70 causing it to rotate about its horizontal shaft 72. The zig-zag cam 74 is mounted to the hub 76 and is attached for rotation, by means not shown, to the shaft 72. The zig-zag cam 74 has two lobes which are offset one from the other in a transverse direction, that is, right to left in view of the direction of vehicle travel. As best seen in FIGS. 1 and 8 through 10, the planar side surfaces 75 of the zig-zag cam 74 ride between a cam follower in the form of opposed knife edges 78 which are integral with the tie-bar 80. Accordingly, as the shaft 72 is rotated, the zig-zag cam 74 pushes the tie-bar 80 transversely to an extreme right position illustrated in FIG. 8 and to the extreme left position illustrated in FIG. 9. This is a periodic reversal in direction of lateral motion of the tie-bar 80 as the shaft 72 rotates. Thus rotation of the motor 18 is translated through the snail gear 54, the cluster gear 60, steering gear 70, and zig-zag cam 74 into a periodically reciprocating action of the tie rod 80. The lateral motion of the tie-rod occurs only during each revolution of the shaft 72 when the diagonal sections 77 of the zig-zag cam 74 pass between the knife edges 78 on the tie-bar 80. Thus the sliding motion of the tie-bar 80 and, as explained hereinafter, the turning of the front wheels 82 is not a continuous motion, but is a steady state dwell condition followed by a rapid swerving of the front wheels 82 alternately to the right and to the left. During the dwell period, the front wheels 82 remain turned as indicated in solid broken lines in FIGS. 1 and 5, to bias the car against the adjacent side wall or rail of the track.

The periodic action of the tie-bar 80 and the front wheels 82 is directly connected to the rotation of the motor by the fixed ratios in the gear linkages. Also, because the rear wheels 16 turn when the motor 18 is energized, there is a direct ratio between the number of rotations of the rear wheels and the changes in direction of the front wheels 82. Thus, if it is assumed that there is no slippage between the rear wheels 16 and the track surface, the front wheels 82 would change direction, and the vehicle 10 would change direction, when a constant distance along the track had been traversed regardless of the speed of the vehicle 10 in traversing that distance.

The right and left front wheels 82 rotate freely on independent axles 83 at opposite ends of the tie-bar 80 where they are similarly attached. As most clearly illustrated in FIG. 10, the front wheel 82 is connected to the tie-bar 80 via an intermediate tie-rod 84. One end of the tie-rod 84 is pivotably mounted to the chassis 12 by means of the vertical pivot pin 86, and at the other end the tie-rod 84 is pivotably mounted to the tie-bar 80 by means of the vertical steering pin 88. As indicated by the broken lines in FIG. 10, the tie-rod 84 pivots about pin 86 as the tie-bar 80 reciprocates in the transverse direction indicated by the double-ended arrow 90.

For clarity of illustration, the appearance shell which is customary on miniature toy vehicles of this type has been omitted from the drawings. U.S. Pat. No. 3,964,206 illustrates with phantom lines the location of the appearance shell on a typical vehicle of this type. The appearance shell is held in position by engagement between the appearance shell and the side brackets 92 integral with the chassis 12.

The toy vehicle of this invention requires no operator for its performance on the track. The vehicle 10 operates on a multi-lane track so long as, in the conventional usage of such tracks, one track is energized by at least one operator. Side rails or walls on the track limit the lateral excursions of the vehicle from side to side, the sliding contact between the rail and vehicle being absorbed by the appearance shell of the vehicle 10.

Figure 11:
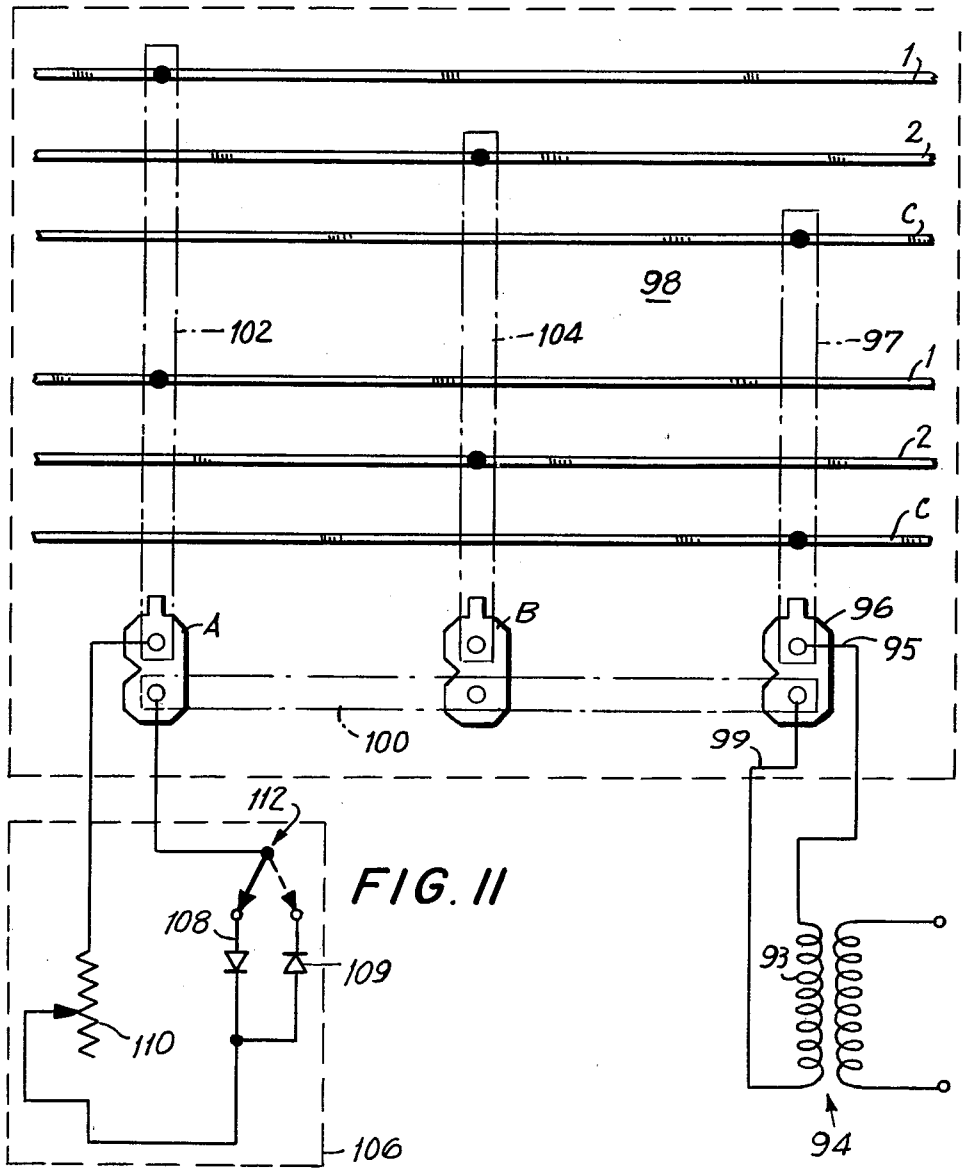
FIG. 11 is a plan view of a section of the racetrack used with the vehicle of FIG. 1 showing two race lanes.

FIG. 11 illustrates, for an example, a portion of a dual-lane track. Each lane includes three strip conductors 1, 2, C, parallel to each other and running continuously around a closed loop track. The secondary winding 93 of a step-down transformer 94 is connected at terminal 95 to the C strip conductors of both lanes via the power plug 96 and the connector 97 running beneath the track surface 98. The other transformer secondary terminal 99 is connected to one terminal of the operator plugs A, B by means of the under-track connector 100. The other terminal of the plug A connects to the strip conductors designated 1 via the under-track connector 102, and the other terminal of the operator plug B connects to the strip conductor designated 2 via the under-track connector 104.

When a controller 106 is plugged into the operating plug A, then an electrical potential from the secondary 93 of the transformer 94 appears across the strip conductors C and 1 in both lanes. No current flows until a car with a motor or other load is placed on the track surface 98 to make contact with the powered strip conductors 1, C in order to complete an electrical circuit. Although an AC voltage appears across the secondary winding 93 of the transformer 94, only a DC current is delivered to the strip conductors 1, C when a car is on the track due to the rectifying action of the diode 108 in series with the variable resistor 100. Thus only half-wave DC power is available to any vehicle which draws its energy solely from conductor strips 1 and C. The polarity of the DC power available to those tracks depends on the position of the signal pole double-throw switch 112 which connects to either diode 108 or an oppositely poled diode 109. It should be obvious that if the controller 106 is connected to the other operator plug B, the strip conductors 2 and C will be energized with half-wave DC power, and if two controllers are connected, one to each operator plug A and B, then there will be DC power available between the combinations of conductors 1 and C and 2 and C. In this way, in the known manner, two cars can be operated in two lanes under independent control, and in fact both cars can operate on the same lane still independently controlled by individual controllers and operators. Each conventional racing car normally used with these tracks requires only two of the strip conductors for operation of its motor M (FIGS. 12*a*, 12*b*).

Figure 12A:
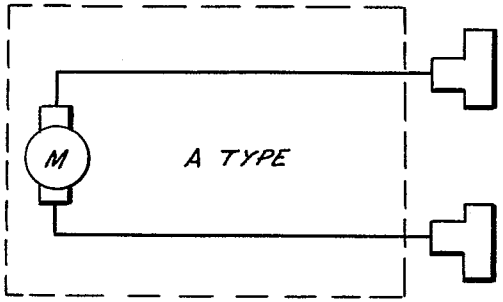
FIG. 12*c* is an electrical schematic of the vehicle of FIG. 1**.
Figure 12B:
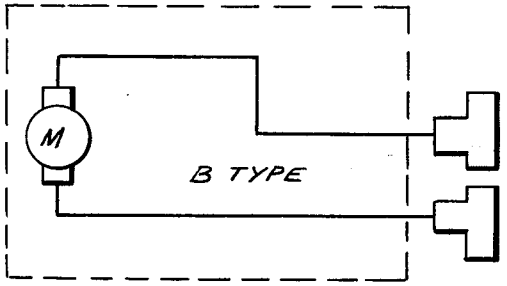

The conventional A type car FIG. 12*a* has two pick-up shoes spaced apart to engage the conductor strips 1, C and thus can be operated only via the operator plug A. The conventional B type car FIG. 12*b* has two pick-up shoes spaced apart to engage the conductor strips 2, C and thus can be operated only via the operator plug B. When the A and B type cars are steerable, they can be directed individually by the operator to switch from lane to lane and travel in either lane. Avoidance of the swerving, unattended vehicle 10 of this invention is an added challenge for the car operators.

As stated above, three pick-up shoes 19, 20, 21 of conventional design are located on the underside of the chassis 12 and are electrically connected by wiring 114 to the circuit board 116 which in turn is connected to the motor 18. The pick-up shoes are transversely spaced such that when the vehicle 10 of this invention is positioned on one lane of the track, each shoe 19, 20, 21 will be in electrical contact with one of the strip conductors 1, 2, C. More particularly, if the vehicle 10 of this invention is moving from right to left on the track illustrated in FIG. 11, then the pick-up shoe 19 (FIG. 1) contacts the strip conductor 1; the central pick-up shoe 20 contacts the central strip conductor 2 and the pick-up shoe 21 is in contact with the strip conductor C. The same connections are made whenever the vehicle 10 is placed on either lane of the track. Examination of the circuit board 116 (FIG. 12*c*) indicates that the vehicle 10 of this invention will receive DC power when either or both operator plugs A, B are powered. The vehicle 10 of this invention will then operate and travel around the track whether or not any other individually controlled race-car, or more than one car, is on the track.

The circuit board 116 has six diodes 118–123 mounted on its upper surface. The negative terminal of the motor 18 connects to the anodes of three diodes 119, 121 and 123. And the positive terminal of the motor 18 connects to the cathode of three diodes 118, 120, 122. Pick-up shoe 19 connects to the anode of diode 118 and to the cathode of diode 123. Pick-up shoe 21 connects to the cathode of diode 119 and to the anode of diode 120.

Figure 12C:
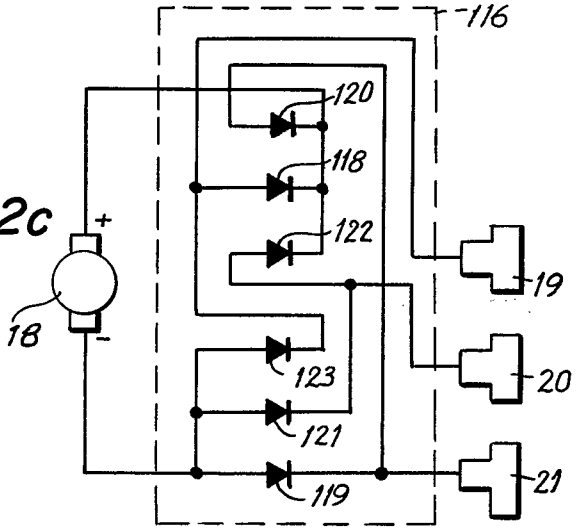

When the strip conductor 1 is positive with respect to strip conductor C, then pick-up shoe 19 connects to the positive terminal FIG. 12*c* of the motor 18 by way of a diode 118 and the circuit is completed to conductor C via the diode 119 and pick-up shoe 21. When the strip conductor C is positive with respect to the strip conductor 1, that is, the polarity is reversed from the example cited immediately above, then current flows to the motor 18 through pick-up shoe 21 via diode 120 and back to the pick-up shoe 19 and strip conductor 1 via the diode 123. It should be noted in both instances of polarity reversal, the current flows through the motor 18 in the same direction (+ to −). Therefore the vehicle travels in the forward direction regardless of the polarity of the voltage which exists between the strip conductors 1 and C.

When the strip conductor 2 is positive with respect to the common strip conductor C, current to the motor flows through pick-up shoe 20 and through the diode 122. The current returns from the motor via the diode 119 and pick-up shoe 21 to the conductor C. When the strip conductor C is positive with respect to the strip conductor 2, then current flows to the motor 18 through the pick-up shoe 21, diode 120 and returns from the motor 18 via the diode 121 and pick-up shoe 20 to conductor strip 2. In every one of the combinations described above of conductor strips and voltage polarities, the current always flows through the motor 18 in the same direction. Therefore the vehicle 10 of this invention, when powered on either lane and by any combination of voltage polarities, will always travel in the same direction around the racetrack. This is true whether strip conductors 2 and 1 have the same polarity with respect to strip conductor C or have opposite polarities with respect to strip conductor C. When strip conductors 1 and 2 have opposite polarities with respect to strip conductor C, then the motor 18 in the vehicle 10 of this invention receives full wave DC power through the circuit of the circuit board 116.

As stated above, the vehicle 10 of this invention moves in a forward direction around the track whenever it is in any lane and power has been applied by the connection of any controller, for example, controller 106. The vehicle 10 of this invention also swerves from side to side, changing lanes with seeming randomness. However, as stated above, the vehicle 10 swerves only after so many revolutions of the motor 18 as determined by the gearing incorporated in the mechanism. The vehicle remains powered in either lane and moves in the forward direction regardless of the voltage polarity applied to the strip conductors. The vehicle moves with a speed determined by the operators in setting the variable resistors, for example, variable resistor 110 in controller 106. As the vehicle 10 of this invention swerves and crosses between lanes there is a region where the pick-up shoes 19, 20, 21 are not in contact with any pair of strip conductors and the motor is de-energized. At this time, the rear wheels 16 are disengaged from the motor shaft 22 due to the action of the pin 40 moving in relation to the cam profile 38 as described above. Thus the rear wheels 16 freewheel. The vehicle moves from lane to lane without any hindrance, restriction or skidding due to a locking of the rear wheels otherwise might occur if the wheels 16 were not disengaged from the motor 18. The vehicle 10 travels swervingly around the track without any attention paid to its operation by the operators of the other vehicles on the track other than the necessity of avoiding vehicle 10 in the control of their toy vehicles. In fact, once the track has been energized by the actuation of one controller, there need be no other cars on the track in order to facilitate automatic operation of the swerving vehicle 10 of this invention.

Although the vehicle 10 of this invention is described and illustrated as having driven rear wheels and steerable front wheels, it should be understood that in alternative embodiments of this invention the front wheels may be driven and the rear wheels may be steerable. Also, the number of wheels on the vehicle is not limited to four. At least one steerable and one driven wheel are required in a completely wheeled vehicle, however, there is no upper limit to the number of wheels which may be either steerable or driven within the physical limitations and constraints of the toy vehicles and their tracks. It is also within the scope of this invention, that the steerable elements be runners or skids rather than wheels, and the driven elements may include continuous track drives. Accordingly such vehicles as snowmobiles with runners in the front and continuous track drive at the rear would fall within the scope of this invention as would for example half-track tanks with wheels at the front and continuous belt drives at the rear. Accordingly it can be seen that the scope of this invention is not limited by the members attached to the outer extremeties of the axles.

It will thus be seen that the objects set forth above, among those made apparent from the preceding description, are efficiently attained, and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention, which, as a matter of language, might be said to fall therebetween.

What is claimed is:

1. A miniature toy vehicle comprising:

a vehicle chassis;

a plurality of wheels mounted on said vehicle chassis for rotation in frictional contact with a surface, whereby said vehicle travels on said surface, a first portion of said plurality of wheels being pivotable for steering and a second portion of said plurality of wheels being non-pivotable and positioned in a longitudinal direction;

means for driving at least one wheel in said non-pivotable portion of said plurality of wheels to cause longitudinal motion of said vehicle on said surface;

means for pivoting at least one wheel in said pivotable portion of said wheels, said at least one pivotable wheel being pivoted about an axis not parallel to the rotational axis of said at least one pivotable wheel;

said means for pivoting at least one wheel in said pivotable portion of said wheels including:

a tie-bar connected to said at least one pivotable wheel;

a cam and a cam follower, said cam in contact with cam follower, said cam when rotating being contoured to cause said tie-bar to translate laterally in reciprocal motion whereby said pivotable wheel is pivoted alternately from left to right so as to produce a zig-zag path of travel for said vehicle;

means for rotating said cam, said means for rotating said cam being operatively connected with said means for driving said at least one wheel in said non-pivotable portion of wheels;

said operative connection between said non-pivotable portion of wheels and said rotating cam includes a snail gear driven when said at least one non-pivotable wheel is driven, said snail gear having one tooth of extended length, said tooth forming an open spiral around the axis of rotation of said snail gear;

a spur gear having its axis of rotation transverse to the axis of rotation of said snail gear, said one tooth of said snail gear being interposed between two adjacent teeth of said spur gear, whereby rotation of said snail gear about its axis causes said spur gear to rotate.

2. The miniature toy vehicle of claim 1, wherein said one elongated tooth is engaged between said two adjacent teeth of said spur gear for substantially an entire revolution of said snail gear, said elongated tooth of said snail gear releasing one of aid adjacent teeth of said spur gear upon the simultaneously engaging another adjacent tooth on said spur gear, whereby said spur gear rotates through an angle representative of one spur gear tooth spacing for each full revolution of said snail gear and a speed reduction is effected between the rotational rate of said at least one driven non-pivotable wheel and the rotation of said cam.

3. The miniature toy vehicle of claim 1, and further including a shaft whereon said cam is affixed and rotates, a steering gear affixed to said shaft and rotating with said cam, a worm gear affixed to and rotating with said spur gear, said worm gear engaging said steering gear, whereby said rotation of said snail gear is transmitted to said rotating cam at a reduced speed.

4. The miniature toy vehicle of claim 1 or 3, wherein said means for driving at least one wheel in said non-pivotable portion of wheels is an electric motor, said electric motor also driving said means for pivoting said at least one wheel in said pivotable portion of said wheels.

5. The miniature toy vehicle of claim 4, and further comprising circuit means for controlling said electric motor, said circuit means being adapted to rotate said electric motor in one direction regardless of the voltage polarity applied thereto.

6. The miniature toy vehicle of claim 4, and further including means for disengaging said non-pivotable portion of said wheels when said electric motor is de-energized, and for driving said at least one wheel in said non-pivotable portion of wheels when said electric motor is energized.

7. The miniature toy vehicle of claim 6, wherein said means for disenagagement and driving includes:

a slidable pin passing transversely through the axle of said at least one non-pivotable wheel;

a cam profile rotationally driven by said electric motor and rotatably mounted on said axle, said pin being engaged and rotationally driven by said cam profile when said motor is energized, whereby said at least one non-pivotable wheel is driven, said pin translating undriven over said cam profile when said at least one non-pivotable wheel rotates and said electric motor is de-energized, whereby said non-pivotable wheel rotates freely.

8. The miniature toy vehicle of claim 6, wherein said cam profile is rotationally driven by a worm gear connected to said motor, said worm gear engaging a crown gear, said crown gear being integral with said cam profile.

9. The minature toy vehicle of claim 1, wherein said first portion of said wheels are at the forward end of said toy vehicle and said second portion of said wheels are at the rear end of said toy vehicle.

10. The miniature toy vehicle of claim 5, wherein said motor is a DC motor and said circuit means for unidirectional rotation of said electric motor includes:

a first, a second, and third pick-up shoe;

six diodes, the negative terminal of said motor connecting to the anodes of the first, second and third diodes, the positive terminal of said motor connecting to the cathodes of the fourth, fifth and sixth diodes, the third pick-up shoe connecting to the anode of the fourth diode and to the cathode of the third diode, and second pick-up shoe connecting to the cathod of the second diode and the anode of the sixth diode, and the first pick-up shoe connecting to the cathode of the first diode and to the anode of the fifth diode, whereby said motor rotates in the same direction when a voltage of either polarity is applied between the first and second pick-up shoes or between the first and third pick-up shoes or simultaneously between the first and second and first and third pick-up shoes.

11. The miniature toy vehicle of claim 10, wherein said three pick-up shoes are located beneath said vehicle chassis, said pick-up shoes being spaced apart to contact individual strip conductors on said surface whereon said vehicle travels, said strip conductors spaced on said surface to accommodate at least two independent racing vehicles, said racing vehicles requiring only two of said strip conductors for operation.

* * * * *